United States Patent [19]

Szabó et al.

[11] Patent Number: 4,509,983

[45] Date of Patent: Apr. 9, 1985

[54] METHOD OF MANUFACTURING A FOUNDRY MOULD MIX CONTAINING A MOULD BINDER

[75] Inventors: Ervin I. Szabó, Manotic; Laurence V. Whiting, Ottawa, both of Canada

[73] Assignee: Canadian Patents and Development Limited, Ottawa, Canada

[21] Appl. No.: 580,016

[22] Filed: Feb. 14, 1983

Related U.S. Application Data

[63] Continuation-in-part of Ser. No. 427,678, Sep. 29, 1982, abandoned.

[30] Foreign Application Priority Data

Dec. 7, 1983 [CA] Canada ..... 391636

[51] Int. Cl.[3] ..... B28B 7/34

[52] U.S. Cl. ..... 106/38.2; 106/38.35

[58] Field of Search ..... 106/38.2, 38.3, 38.35; 164/525, 528

[56] References Cited

U.S. PATENT DOCUMENTS 1,528,422 3/1925 Helsley ..... 424/55

4,289,755 9/1981 Dhabhar ..... 424/55

*Primary Examiner*—Lorenzo B. Hayes

*Attorney, Agent, or Firm*—Francis W. Lemon

[57] ABSTRACT

A foundry mould binder is manufactured at least one acid selected from the group consisting of glycolic acid, lactic acid, α-hydroxy butyric acid, valerolactic acid, α-hydroxy-caproic acid, tartronic acid, tartaric acid, malic acid, mucic acid, citric acid, gluconic acid, and glyceric acid, with a precipitant for the acid, and water, the water being present in an amount no greater than 2 times the weight of the total acid content, calculated on that acid content being in a water free state. The precipitant is for admixture with or contains the equivalent to at least 50% of the stoichiometric requirement of the total acid content of the binder component when the total acid content is in solution, said precipitant comprising at least one substance selected from the group consisting of calcium carbonate and substances composed essentially of calcium carbonate, said precipitant being substantially non-fluxing with the foundry sand, and substantially non-reactive with respect to other mould components than the said acid, and substantially non-reactive with respect to metal which is to be cast in the mould. The precipitant is preferably ground limestone, and the binder component may further include at least one humectant (e.g. sorbitol) admixed with the remainder to retard the loss of mould tensile strength during periods of low humidity.

5 Claims, 8 Drawing Figures

METHOD OF MANUFACTURING A FOUNDRY MOULD MIX CONTAINING A MOULD BINDER

Figure 2:
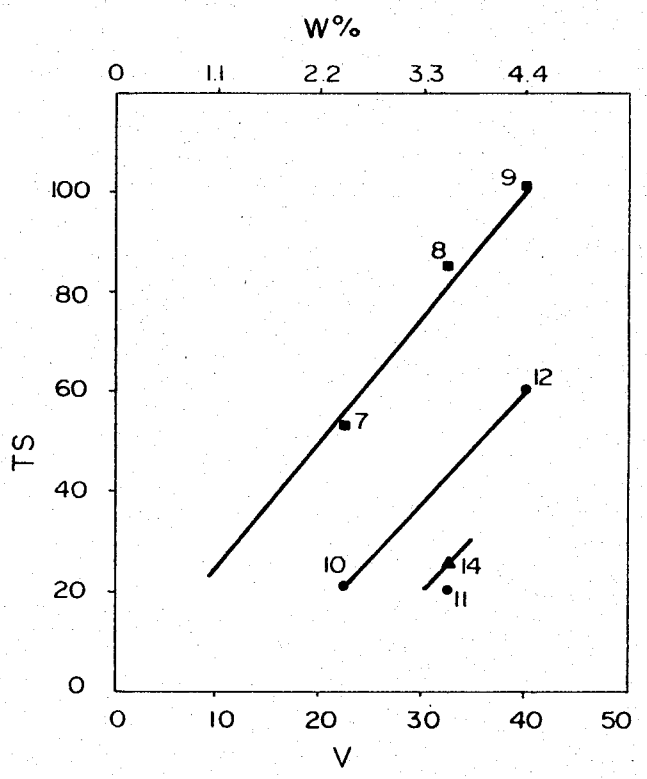

This invention is a continuation-in-part application of U.S. patent application Ser. No. 427,678, filed Sept. 29, 1982, and now abandoned.

This invention relates to a method of manufacturing a foundry mould mix containing a mould binder.

It has been proposed in Canadian Pat. No. 1,099,077, dated Apr. 14, 1981, "Method of producing a foundry mold for casting molten metal", E. I. Szabo, to form a foundry sand containing 2 to 6 weight % of at least one alkaline earth oxide (e.g. magnesium oxide), and then to convert the alkaline earth oxide to alkaline earth oxalate and thus provide a binder for the foundry sand.

While this method, as described, has proved useful in the preparation of foundry moulds, moulds of greater mechanical strength may be prepared by using a substance which may be prepared in solutions of higher concentrations than possible with oxalic acid, or using a substance (or substances) which are liquid at the temperature of interest. In addition to the improved mechanical strength to be had by this approach, additional benefits may accrue, inasmuch as the lesser amount of fluid that is to be incorporated in the moulding mix reduces sticking between the sand and the pattern.

Yet further benefits that may be anticipated from such a modification are the reduction the emission of vapours and gases during casting, hence, commensurately improving the foundry environment and casting quality; reduction in the size of containers also leads to economies, etc.

Thus, there is a foreseeable need for a foundry mould binder substance for mixing with foundry sand, which is:

(a) available as a fluid in high concentrations (or is fluid at the temperature of interest) so that only little or no excess solvent is present to effect the mould strength adversely and to increase stickiness between the moulding sand and the pattern, (b) it is further desirable that such a compound should also be essentially non-toxic so that it may be handled without special precautions.

According to the present invention, there is provided a method of manufacturing a foundry mould mix containing a mould binder comprising a method of manufacturing a foundry mould mix containing a mould binder, comprising:

(a) mixing a binder with foundry sand in the range 15 to 150 grams of binder per kilogram of foundry sand, the binder consisting essentially of:

(i) at least one acid selected from the group consisting of glycolic acid, lactic acid, α-hydroxy butyric acid, valerolactic acid, α-hydroxy-caproic acid, tartronic acid, tartaric acid, malic acid, mucic acid, citric acid, gluconic acid, and glyceric acid, (ii) a precipitant for the acid, the amount of precipitant present being equivalent to at least 50% of the stoichiometric requirement of the total acid content of the binder components, said precipitant comprising at least one substance selected from the group consisting of calcium carbonate and substances composed essentially of calcium carbonate, said precipitant being substantially non-fluxing with the foundry sand, and substantially non-reactive with respect to other mould components than the said total acid content, and substantially non-reactive with respect to metal which is to be cast in the mould; and (b) water, the water being present in an amount no greater than 2 times the weight of the total acid content, calculated on that acid content being in a water free state.

In some embodiments of the present invention, the precipitant is ground limestone.

In some embodiments of the present invention, the amount of ground limestone as the precipitant present is an amount equivalent to at least 200% of the stoichiometric requirement of the total acid content of the binder components when the total acid content is in solution.

In some embodiments of the present invention, the binder includes at least one humectant admixed with the remainder. Preferably, the humectant is sorbitol.

The Acids with the International Union of Chemistry name shown in brackets when so designated glycolic acid (hydroxy acetic)
lactic acid (α-hydroxy-propionic)
α-hydroxy butyric acid (2-hydroxybutanoic)
valerolactic acid (α-hydroxy valeric)
α-hydroxy-caproic acid
tartronic acid (2-hydroxypropanedioic)
tartaric acid (2,3-dihydroxy-butanedioic)
malic acid (hydroxybutanedioic)
mucic acid (2,3,4,5-tetrahydroxyhexanedioic)
citric acid (2-hydroxy-1,2,3-propanetricarboxylic)
gluconic acid (2,3,4,5,6 pentahydroxy-1-hexanoic)
glyceric acid (2,3-dihydroxy-propanoic)

Examples of precipitants (i) calcium carbonate
(ii) substances composed essentially of calcium carbonate, e.g.,
(a) ground limestone,
(b) chalk,
(c) dolomite,
(d) ground marble, and
(e) pulverized exoskeletons.

Examples of preferred humectants (i) glycerol (1,2,3 propanetriol)
(ii) sorbitol a (1,2,3,4,5,6 hexanehexol) or glucitol
(iii) (1,2,6 hexanetriol)
(iv) triethylene glycol (2,2' ethylenedioxydiethanol)
(v) trimethylene glycol (1,2 propanediol) or (1,3 propanediol)
propylene glycol In the total absence of water from the mould binders, according to the present invention, no reaction takes place and so the binder components, other than water, may be stored in a premixed condition and activated when desired by adding the water component thereto.

The water to be added to the other binder components in a dry, premixed condition is governed by the necessity of making the mix mouldable, in addition to the amount required to initiate reaction.

When the water component is present in an amount in excess of 2 times the total weight of the acid content, calculated on that acid content being in a water free state, the mould so produced is unduly weakened by excess water.

The preference of an acid or an acids mixture, according to the present invention, for a particular method of mould production or a particular foundry operation, may have to be determined empirically by routine experiments because the reaction speeds of the acids, or mixtures thereof, vary and the relatively faster acting species, e.g. solutions of glycolic, tartaric and malic acids, are better suited for relatively faster mixing and mounding techniques.

The desirability of some acids or acid mixtures, according to the present invention, for relatively slower methods of mould production or other relatively slower foundry operations, such as, for example, manual methods of mould production or other manual foundry operations, may be enhanced by using a particular amount of one or more particular acids according to the present invention, e.g. gluconic acid and lactic acid, to moderate the speed of reaction of a particular amount of one or other acids according to the present invention, having relatively faster speeds of reaction, e.g. citric acid, malic acid and tartaric acid. The amounts of such acids for a particular foundry mould use can readily be determined by routine experiments.

Further, the desirability of some acids or acid mixtures, according to the present invention, such as, for example, citric acid, malic acid and tartaric acid, for relatively slower methods of mould production or other relatively slower foundry operations, for example, manual methods of mould production or other manual foundry operations, may be enhanced by using at least one reaction moderator, such as, for example, sorbitol, glycol and glycerol, used with or without, for example, gluconic acid and lactic acid, as an additional reaction moderator.

Figure 1:
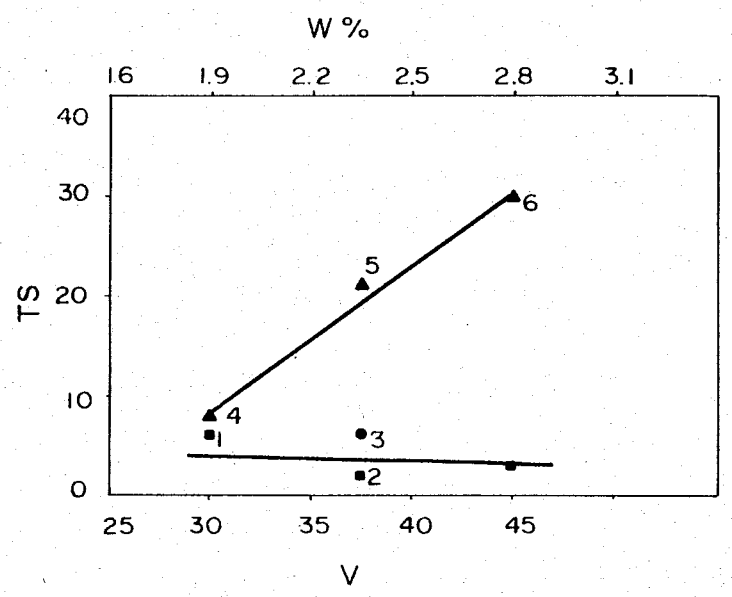
Figure 4:
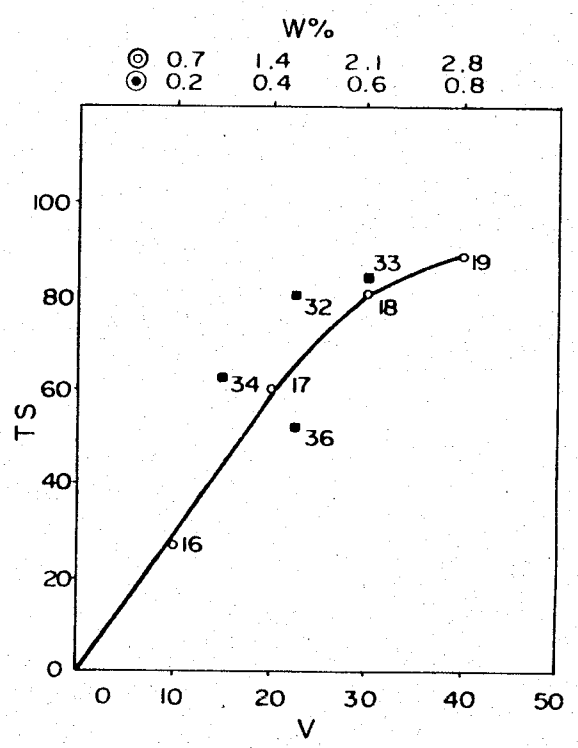
Figure 3:
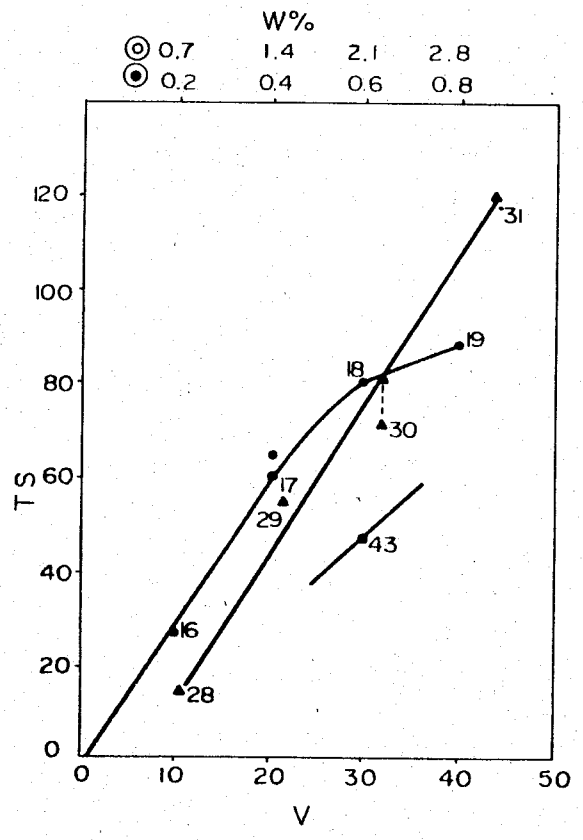
Figure 6:
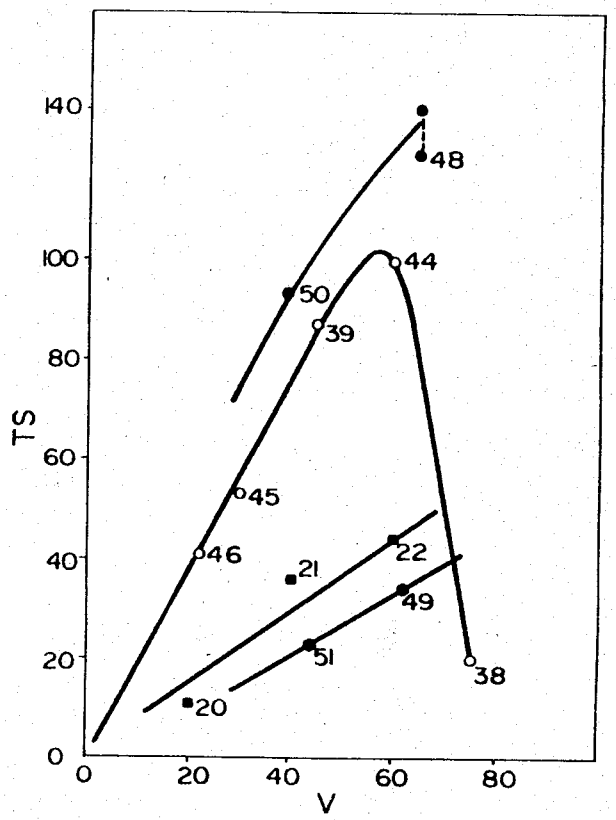
Figure 5:
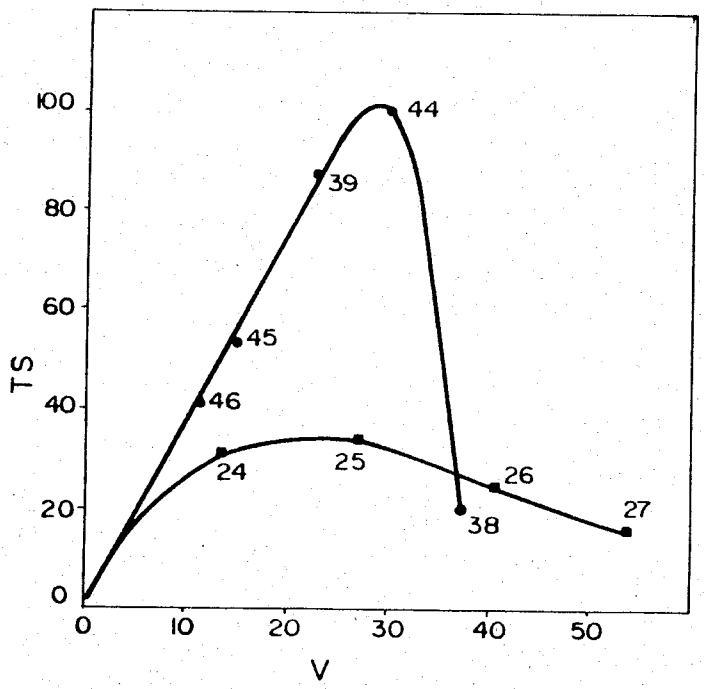
Figure 7:
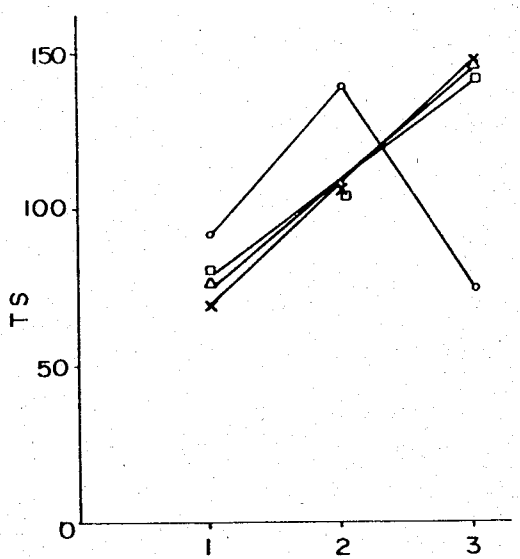
Figure 8:
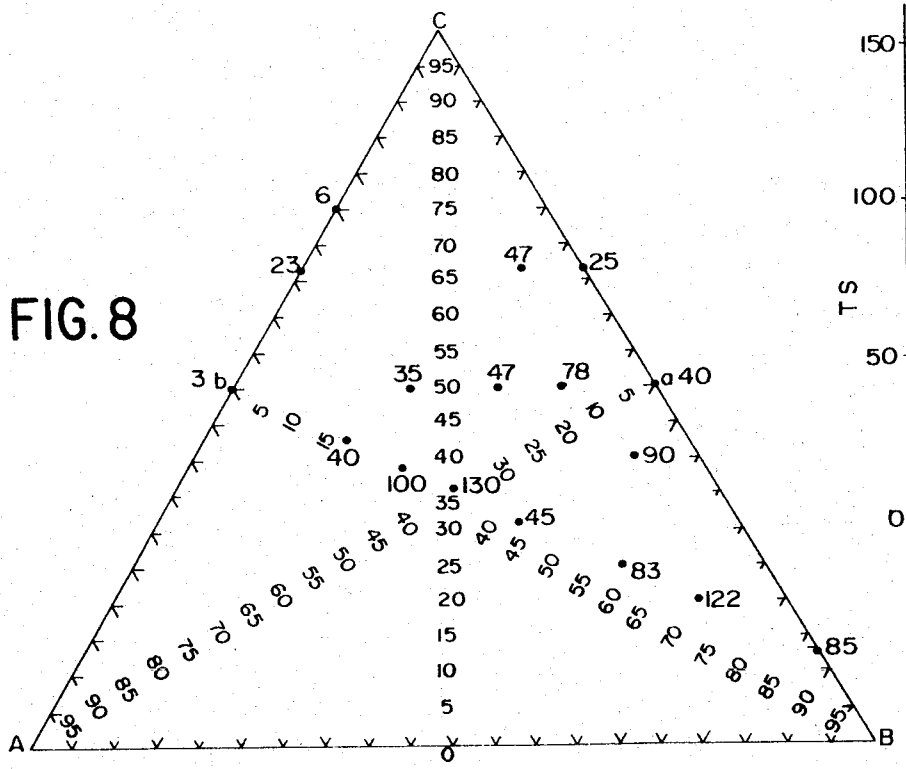

In the accompanying drawings which illustrate, by way of example, embodiments of the present invention, FIG. 1 is a graph showing the effect of citric acid and water content on the strength of citric acid-limestone ($3\frac{3}{4}$ w/o) bonded sands for foundry moulds with no humectant added, FIG. 2 is a graph showing the effect of lactic acid and water content on, lactic acid-limestone ($3\frac{3}{4}$ w/o) bonded sands for foundry moulds with no humectant added, FIG. 3 is a graph showing the effect of water and acid concentration on strengths of 2:1 lactic acid to citric acid-limestone ($3\frac{3}{4}$ w/o) bonded sands for foundry moulds with no humectant added, FIG. 4 is a graph showing the effect of acid and limestone contents on the strength of two parts lactic acid to one part citric acid-limestone bonded sands for foundry mould with no humectant added, FIG. 5 is a graph showing the effect of water and acid concentration on the strengths of 1:2 lactic acid to citric acid-limestone ($3\frac{3}{4}$ w/o) bonded sands for foundry moulds with no humectant added, FIG. 6 is a graph showing the effect of acid concentration on the strengths of lactic acid-citric acid-limestone ($3\frac{3}{4}$ w/o), bonded sands for foundry moulds with no humectant added, with assorted citric acid-lactic acid mixes which are high in citric acid content, FIG. 7 is a graph showing the effect of glycerol additions, as humectant, on the mould strength in relation to atmospheric humidity, and FIG. 8 is a triangular diagram summarizing the mould strengths of different stoichiometric mixes with no humectant added.

It is to be noted that the data depicted in FIGS. 1–7 have been observed on specimen test pieces prepared at and exposed to atmospheric humidities in the range of 50 to 65% relative, whereas the information illustrated in FIG. 8 was obtained under lower and varying conditions of relative humidity. More detailed information is given in the following Tables I and VIII, wherein Tables I to VI are numbered corresponding with FIGS. 1 to 6. The mix for Tables I to VI contained a limestone having a 96 wt.% calcium carbonate content. Superior results in duplicate tests have been obtained with type 501 limestone (see Tables VII to VIII).

The results of Table I are illustrated graphically in FIG. 1 where tensile strength (TS), of the test piece as prepared, in psi (0.07 kg/cm$^2$) is plotted against volume (V) mL of commercial citric acid (50%) per kg of sand-mL, and weight % (w/o) citric acid (anhydrous). FIG. 1 illustrates graphically the effect of citric acid and water content on the tensile strength of citric acid-limestone ($3\frac{3}{4}$ w/o) bonded sand foundry mould mixes.

In FIG. 1:

■ designates 50 w/o citric acid

▲ designates 33 w/o citric acid, and

● designates 25 w/o citric acid.

The results of Table II are illustrated graphically in FIG. 2 where tensile strength (TS) is psi (0.07 kg/cm$^2$) is plotted against volume (V) mL of commercial lactic acid (87.5%) per kg of sand, and weight % (w/o) lactic acid. FIG. 2 illustrates the effect of lactic acid and water content on the tensile strength of lactic acid-limestone ($3\frac{3}{4}$ w/o) bonded sand foundry mould mixes.

TABLE I

Citric Acid Water $3\frac{3}{4}$ w/o Limestone-Sand System

| | Mix | | | Tensile Specimen | | | | | | |
|---|---|---|---|---|---|---|---|---|---|---|
| | Citric | Volume/kg | | | | Tensile Strength after | | | Relative | |
| Expt. No. | Acid w/o | Acid ml | water ml | Weight g | Knife Hardness | 6 hr | 24 hr PSI | 48 hr | Humidity % | Comments |
| 1 | 50 | 30 | | 95.8[1] | 68 | 3 | 6 | 6 | 45–75 | |
| 2 | 50 | 37.5 | | 85.4[1] | 40 | 0 | 6 | 2 | 50–75 | deliquescent |
| 3 | 50 | 45 | | 100.8 | 90 | 2 | 2 | 3 | 40–50 | |
| 4 | 33 | 30 | 9.3 | 94.7 | 60 | 1 | 8 | 8 | 40–83 | sticky |
| 5 | 33 | 37.5 | 11.5 | 99.4 | 73 | 2 | 20 | 18 | 40–83 | parts handlable in 10–15 mins. |
| 6 | 33 | 45 | 14 | 102.0 | 93 | 7 | 34 | 24 | 39–50 | |
| 37 | 25 | 40 | 40 | 101.8 | 80 | 3 | 4 | 6 | 38–74 | |

Volume of commercial (50%) citric acid per kilogram of sand

[1]Standard deviation of weights of test pieces more than 2 g.

TABLE II

| Lactic Acid Water 3¾ w/o Limestone - Sand System | | | | | | | | | | | |
|---|---|---|---|---|---|---|---|---|---|---|---|
| Mix | | | | Tensile Specimen | | | | | | | |
| | Lactic | Volume/kg | | | | Tensile Strength after | | | | Relative | |
| Expt. No. | Acid w/o | Acid ml | water ml | Weight g | Knife Hardness | 6 hr | 24 hr | 48 hr | 72 hr | Humidity % | Comments on mix |
| | | | | | | PSI | | | | | |
| 7 | 87.5 | 23.5 | | 99.3[1] | 88 | 0[2] | 1[2] | 60 | 44 | 40–83[2] | |
| 8 | 87.5 | 32.5 | | 98.3 | 95 | ½[2] | 1[2] | 60 | 106 | 40–83[2] | 15 |
| 9 | 87.5 | 40 | | 103.9 | 95 | 25 | 85 | 101 | | 38–50 | good finish |
| 10 | 50 | 23.5 | 20.5 | 92.4[1] | 74 | 2[2] | 27 | 21 | | 38–83[2] | very dry |
| 11 | 50 | 32.5 | 29.5 | 94.5[1] | 80 | 3[2] | 6[2] | 20 | | 38–83[2] | poor packing |
| 12 | 50 | 40 | 36.5 | 98.6 | 94 | 10 | 50 | 60 | | 38–50 | deliquescent |
| 14 | 33 | 32.5 | 64 | 97.6[1] | 94 | 5 | 15 | 25 | | 38–50 | lumpy |
| 8.bagged | 87.5 | 32.5 | | 97.8 | 93 | ½ | 10 | 45 | 68 | | |

Volume of commercial (87.5%) lactic acid per kg. of sand.
[1]Standard deviation of weights of test pieces more than 2 g.
[2]Relative humidity high (70%) during early part of experiment.

In FIG. 2:

■ designates 87.5 w/o lactic acid
▲ designates 50 w/o lactic acid, and
● designates 33 w/o lactic acid.

The results of Table III are illustrated graphically in FIG. 3 where tensile strength (TS) in psi (0.07 kg/cm$^2$) is plotted against combined volume (V) of commercial lactic acid and citric acids in mL/kg of sand, and weight % (w/o) lactic ◎ and citric ⊙ acids. FIG. 3 illustrates the effect of water and acid concentration on the strengths of 2:1 lactic-citric acids-limestone (3¾ w/o) bonded sand foundry mould mixes.

In FIG. 3:

● designates 75 w/o combined acids,
▲ designates 50 w/o combined acids, and
■ designates 33 w/o combined acids.

The curvature of the 75 w/o solution, designated ● can be attributed to the slow development of strength of the more concentrated formulations particularly during humid conditions.

The results of Table IV are illustrated graphically in FIG. 4 where tensile strength (TS) in psi (0.07 kg/cm$^2$) is plotted against combined volume (V) of commercial lactic and citric acids in mL/kg of sand, and weight % (w/o) lactic ⊙ and citric O . FIG. 4 illustrates the effect of acid and limestone contents on the strength of two parts lactic acid to one part citric acid-limestone bonded sand foundry mould mixes.

In FIG. 4:

● designates 3¾ w/o limestone, and
■ designates 2½ w/o limestone.

Further tests indicated that for longer observation periods (more than the usual 48 hrs) for the 3¾ w/o limestone level, the tensile strength reaches a maximum more rapidly at the lower 2½ w/o limestone than at 3¾ w/o.

TABLE III

| 2 Parts Lactic: 1 Part Citric Acids - Water - 3¾ w/o Limestone - Sand System | | | | | | | | | | | | |
|---|---|---|---|---|---|---|---|---|---|---|---|---|
| Mix | | | | | Tensile Specimen | | | | | | | |
| | Lactic | Citric | Volume/kg | | | | Tensile Strength after | | | | Relative | |
| Expt. No. | Acid w/o | Acid w/o | Acid ml | Water ml | Weight g | Knife Hardness | 6 hr | 24 hr | 48 hr | 72 hr | Humidity % | Comments on mix |
| | | | | | | | PSI | | | | | |
| 16 | 58 | 17 | 10 | | 97.9[1] | 70/50[2] | 19 | 15 | 28 | | 40–83 | |
| 17 | 58 | 17 | 20 | | 97.4 | 73 | 18 | 24 | 65 | | 49–83 | very sticky |
| 18 | 58 | 17 | 30 | | 95.0 | 77 | 0[3] | 3[3] | 85 | | 40–83 | very sticky |
| 19 | 58 | 17 | 40 | | 99.6[1] | 90 | 0[3] | 2[3] | 94 | 75 | 40–83 | very sticky & poor surface. |
| 28 | 37.5 | 11.5 | 10.6 | 6.6 | 98.6[1] | 43 | 10 | 15 | 5 | | 37–68 | |
| 29 | 37.5 | 11.5 | 21.8 | 13.2 | 101.0[1] | 89 | 20 | 45 | 45 | | 37–68 | |
| 30 | 37.5 | 11.5 | 32.7 | 19.9 | 103.4 | 93 | 35 | 51 | 81 | | 37–68 | |
| 31 | 37.5 | 11.5 | 43.6 | 26.5 | 107.2 | 93 | 30 | 96 | 138 | | 37–68 | |
| 43 | 25.6 | 7.5 | 30 | 45.5 | 105.2 | 92 | 13 | 35 | 47 | | 38.55 | |
| 17 bagged | 58 | 17 | 20 | | 99.5 | 90 | 17 | 40 | 44 | | | |

Combined volumes of commercial acids (i.e. 75 w/o acid) per kg. sand
[1]Standard deviation of weights of test pieces weights more than 2 g.
[2]Crumbles after 24 hours.
[3]Humidity 72%.

TABLE IV

| 2 Parts Lactic: 1 Part Citric Acid - Water - Limestone-Sand System | | | | | | | | | | |
|---|---|---|---|---|---|---|---|---|---|---|
| | Addition per kg of sand | | Tensile Specimen | | | | | | | Relative |
| Expt. No. | Limestone g/kg | Acid mL/kg | Weight g | Knife Hardness | Tensile Strength after 6 hr | 24 hr | 48 hr | 72 hr | % | Humidity % |
| | | | 3¾% Weight Limestone | | | | | | | |
| 34 | 25 | 15 | 99.2 | 85/74[2] | 65 | 50 | 50 | | | 37–68 |
| 32 | 25 | 22.5 | 101.2 | 93 | 77 | 80 | 45 | | | 37–68 |
| 33 | 25 | 30 | 102.4 | 92/76 | 15 | 83 | 20 | | | 37–68 |
| 16 | 37.5 | 10 | 97.9[1] | 70/50 | 19 | 15 | 28 | | | 40–83 |
| 17 | 37.5 | 20 | 97.4 | 73 | 18 | 24 | 65 | | | 40–83 |
| 18 | 37.5 | 30 | 95.0 | 77 | 0[3] | 3 | 85 | | | 40–83 |
| 19 | 37.5 | 40 | 99.6 | 90 | 0[3] | 2 | 94 | 75 | | 40–83 |

TABLE IV-continued

| Expt. No. | Addition per kg of sand Limestone g/kg | Acid mL/kg | Tensile Specimen Weight g | Knife Hardness | Tensile Strength after 6 hr | 24 hr | 48 hr | 72 hr % | Relative Humidity % |
|---|---|---|---|---|---|---|---|---|---|
| 2 Parts Lactic: 1 Part Citric Acid - Water - Limestone-Sand System | | | | | | | | | |
| 50% water[4] and 3¾ w/o Limestone | | | | | | | | | |
| 35 | 25 | 218 | 101.6[1] | 88 | 33 | 55 | 26 | | 37-68 |
| 29 | 97.5 | 218 | 101.0[1] | 89 | 20 | 45 | 45 | | 37-68 |
| 100 lbs sand 2½ lb Limestone 1020 mL Acid (equivalent to 22.5 mL/kg. of sand) | | | | | | | | | |
| 36 | 25 | 22.5 | 92.0 | 85 | 30 | 52 | | | 41-68 |
| NINE DAY EXPERIMENT | | | | | | | | | |
| 57 | 37.5 | 18.5 | 95.0 | 83 | 20 | 47 | 51 | 68 | 47.67 |
| 58 | 37.5 | 30 | 98.7 | 90 | | 82 | 82 | 120[5] | |

[1]Standard deviation of test piece weight more than 2 g.
[2]Drops after a while.
[3]Humidity 72%.
[4]Also 13.2 mL of water.
[5]Later dropped to 9 after humidity exceeded 80%.

Subsequent testing showed that mixes containing 3¾ w/o limestone required more time (longer than the usual 48 hour observation period) to reach the same strengths as mixes containing 2½ w/o limestone.

The results of Table V are illustrated graphically in FIG. 5 where tensile strength (TS) in psi (0.07 kg/cm$^2$) is plotted against combined volume (V) of commercial lactic and citric acids in mL/kg of sand. FIG. 5 illustrates the effect of water and acid concentration on strength of 1:2 lactic acid to citric acid-limestone (3¾ w/o) bonded sand foundry mould mixes.

In FIG. 5:

● designates 38.5 w/o water, and

■ designates 50 w/o water.

The results of Table VI are illustrated graphically in FIG. 6 where tensile strength (TS) in psi (0.07 kg/cm$^2$) is plotted against combined volume (V) of commercial lactic and citric acids in mL/kg of sand. FIG. 6 illustrates the effect of acid concentration on the strengths of lactic acid-citric acid-limestone (3¾ w/o) bonded sand foundry mould mixes, with assorted citric acid-lactic acid mixes high in citric acid content.

In FIG. 6:

■ designates a 1:1 ratio lactic acid to citric acid,

● designates a 1:1.6 ratio lactic acid to citric acid,

○ designates a 1:2 ratio lactic acid to citric acid, and

◆ designates a 1:4 ratio lactic acid to citric acid.

Table VII shows a comparison of the tensile strength of limestones of various mesh sizes using 20 mL of 1:1.6 lactic acid to citric acid mix with 2 mL glycerol per kg of Ottawa silica sand.

In FIG. 7 there is shown a graph of test results for the effects of relative humidity and glycerine additions to a mix of 75 g of limestone, 2 kg of Ottawa sand, and 40 mL of 1:1.6 ratio of lactic acid to citric acid.

TABLE V

| Expt. No. | Mix Lactic Acid w/o | Citric Acid w/o | Volume/kg $SiO_2$ Acid* mL | Water mL | Tensile Specimen Weight g[1] | Knife Hardness | Tensile Strength After 6 hr | 24 hr psi | 48 hr | Relative Humidity % |
|---|---|---|---|---|---|---|---|---|---|---|
| 1 Part Lactic 2 Parts Citric Acid - Water - 3¾ w/o Limestone - Sand System | | | | | | | | | | |
| 38 | 24.5 | 37 | 37.5 | | 100.1 | 91 | 2 | 20 | 20 | 38-74 |
| 39 | 24.5 | 37 | 22.5 | | 98.6 | 94 | 15 | 83 | 15 | 44-74 |
| 44 | 24.5 | 37 | 30.0 | | 100.6 | 93 | 37 | 115 | 85 | 38-55 |
| 45 | 24.5 | 37 | 15.0 | | 99.1 | 85 | 53 | 53 | 53 | 38-55 |
| 46 | 24.5 | 37 | 11.8 | | 99.1 | 75 | 45 | 41 | 41 | 38-55 |
| 24 | 20 | 30 | 13.5 | 4 | 99.7 | 80 | 14 | 31 | 31 | 38-50 |
| 25 | 20 | 30 | 27.0 | 8 | 100.7 | 94 | 33 | 38 | 47 | 38-50 |
| 26 | 20 | 39 | 40.5 | 12 | 101.5 | 92 | 17 | 28 | 22 | 38-50 |
| 27 | 20 | 30 | 54 | 16 | 102.7 | 92 | 4 | 17 | 17 | 38-50 |
| 47 bagged | 24.5 | 37 | 22.5 | | NEVER SET | | | | | |

*Combined volumes of commercial acids (61.5% acid) per kg. sand.
[1]Standard deviation of weights of test pieces less than 2 g.

TABLE VI

| Expt. No. | Mix Lactic Acid w/o | Citric Acid w/o | Volume* Acid mL/Bag | Ratio L:C by vol | Tensile Specimen Weight g | Knife Hardness | Tensile Strength after 6 hr | 24 hr PSI | 48 hr | Relative Humidity % | Comments on mix |
|---|---|---|---|---|---|---|---|---|---|---|---|
| Assorted Lactic Acid - Citric Acid - Water - 3¾ w/o Limestone - Sand Systems | | | | | | | | | | | |
| 20 | 25.5 | 36 | 10 | 1:1 | 98.1 | 55/40 | 11 | 12 | 7 | 38-83 | didn't mix |
| 21 | 25.5 | 36 | 20 | 1:1 | 101.5 | 83 | 20 | 40 | 35 | 38-83 | |
| 22 | 25.5 | 36 | 30 | 1:1 | 89 | 89 | 2 | 53 | 42 | 38-83 | |
| 50 | 33 | 31½ | 19.5 | 1:1.6 | 98.2 | 90 | 59 | 93 | 93 | 38-53 | excellent |
| 48 | 33 | 31½ | 32.5 | 1:1.6 | 100.0 | 96 | 40 | 147 | 93 | 38-53 | |
| 46 | 24.5 | 37 | 11.3 | 1:2 | 99.1 | 75 | 45 | 41 | 41 | 38-55 | |
| 45 | 24.5 | 37 | 15 | 1:2 | 99.1 | 85 | 53 | 53 | 53 | 38-55 | |
| 39 | 24.5 | 37 | 22.5 | 1:2 | 98.6 | 94 | 15 | 87 | 15 | 44-74 | |
| 44 | 24.5 | 37 | 30 | 1:2 | 100.6 | 93 | 37 | 115 | 85 | 38-55 | |

TABLE VI-continued

Assorted Lactic Acid - Citric Acid - Water - 3¾ w/o Limestone - Sand Systems

| Expt. No. | Mix: Lactic Acid w/o | Mix: Citric Acid w/o | Mix: Volume* Acid mL/Bag | Mix: Ratio L:C by vol | Tensile Specimen: Weight g | Tensile Specimen: Knife Hardness | Tensile Strength after 6 hr PSI | Tensile Strength after 24 hr PSI | Tensile Strength after 48 hr PSI | Relative Humidity % | Comments on mix |
|---|---|---|---|---|---|---|---|---|---|---|---|
| 51 | 17 | 40.5 | 22.5 | 1:4 | 97.9 | 92 | 38 | 18 | 13 | 38–50 | |
| 49 | 17 | 40.5 | 31 | 1:4 | 98.4 | 91 | 27 | 35 | 17 | 38–53 | |
| 40 | 31 | 19 | 35[2] | 1:1 | 101.7[1] | 85 | 11 | 47 | 46 | 40–74 | |
| 41 | 52.5 | 7.8 | 37.5[2] | 4:1 | 102.9 | 92 | 18 | 95 | 90 | 44–74 | affected by high humidity |
| 42 | 69.8 | 10.3 | 37.5[2] | 4:1 | 101.7 | 94 | 0 | 129 | 120 | 38–74 | |

*Volume of mixed commercial acids (87.5w/o lactic and 50w/o citric) per kg. of sand.
[1]Standard deviation of weight of test pieces greater than 2 g.
[2]Besides mixed acid there was 16 mL of water in Expt 40 and 15 mL in each Expt 41 & 42.

In FIG. 7 tensile strength (TS) in psi (0.07 kg/cm$^2$) is plotted against volume (V) of glycerol in mL/kg of sand, and X designates the strength on the first day at 22% relative humidity, ○ designates the strength on the 2nd day at 42% relative humidity, Δ designates the strength on the 5th day at 25% relative humidity, □ designates the strength on the 12th day at 25% relative humidity.

FIG. 8 summarizes test results for stoichiometric acid additions and 3¾ w/o limestone and A is the ordinate for citric acid, B the ordinate for lactic acid and C the ordinate for water.

Table VIII shows a comparison of the tensile strengths of some commercially available materials mixed in the laboratory muller.

To minimize the loss of strength during periods of relative humidity, humectants were introduced into the foundry mould binder substance. A mixture of glycol and s-trioxan was found to help delay the loss of strength, however, the odour of s-trioxan is said to have caused dizziness in one moulder, and that the formaldehyde induced discomfort during casting and shakeout. This combination was abandoned therefore and was replaced with glycerol, which was found to be extremely sensitive to fluctuations of atmospheric humidity, and later with sorbitol, which offered a less variable set of properties.

With the introduction of a humectant, it was found that solutions of acid mixtures which previously had tended to reject solids on standing now became stable. Syrups containing 20 wt.% water were stable at temperatures ranging down to 12°–15° C. and though "stiff", no solids appear to have been precipitated. These low water-syrups were also slow to harden, occasionally requiring 24–36 hrs for the mass to harden when evaporation was prevented. (i.e. in a bag, or the mould was covered with polyethylene sheet. These selfsame samples would re-soften, however, under conditions of high humidity. Humectants should preferably be omitted from the binder formulations when such conditions prevail or are anticipated.)

TABLE VII

Effect of Limestone Particle Size on Tensile Properties

| Limestone: Type | Limestone: Mesh Size | Maximum Tensile Strength - psi: Limestone addition 25.0 g/kg of sand | Maximum Tensile Strength - psi: Limestone addition 37.5 g/kg of sand |
|---|---|---|---|
| 40 | −40 | | 7 |
| 501 | −140 | 126 | 134 |
| 452 | −325 | 143 | 114 |
| 20–0 | −8 | 57 | 35 |
| DOMTAR | −48 | 90* | 95* |

*No glycerol addition.

TABLE VIII

Comparison of Tensile Strength of some Binder Formulations using some Commercially available Materials in the Laboratory Muller.

| Formulation/kg Sand: Limestone g | Formulation/kg Sand: Volume 1:1.6 mL | Formulation/kg Sand: Acid 2:1 mL | Ottawa Silica Domtar Limestone: Tensile Strength psi | Ottawa Silica Domtar Limestone: Relative Humidity % | Ottawa Silica Barnes 501: Tensile Strength psi | Ottawa Silica Barnes 501: Relative Humidity % | Champlain Sand Barnes 501: Tensile Strength psi | Champlain Sand Barnes 501: Relative Humidity % |
|---|---|---|---|---|---|---|---|---|
| | | | 1:1.6 Lactic to Citric Mix | | | | | |
| 20 | 20 | | | | 60* | 49 | | |
| 25 | 20 | | | | 80 | 34 | | |
| | | | | | 120 | 55 | 45* | 49 |
| 25 | 25 | | | | | | 38* | 34 |
| 25 | 30 | | | | | | 90* | 34 |
| 37.5 | 20 | | 93 | 45 | 115 | 58 | | |
| | | | 43 | 49 | 11 150[1] | 55 | 20* | 29 |
| 37.5 | 30 | | 143 | 29 | | | 95 | 29 |
| 37.5 | 32.5 | | 147 | 45 | | | | |
| 37.5 | 37.5 | | | | | | 124 | 29 |
| 37.5 | 50 | | 178 | 55 | | | | |
| | | | 2:1 Lactic to Citric Acid Mix | | | | | |
| 25 | | 37.5 | | | | | 172 | 28 |
| 37.5 | | 22.5 | 68 | 55 | | | 100 | |
| 37.5 | | 30 | 153 | 30 | 150 | 30 | 145 | 30 |
| | | | 153 | 50 | 160 | 50 | 142 | 50 |
| 37.5 | | 37.5 | 150 | 50 | | | 169 | 32 & 52 |

TABLE VIII-continued

Comparison of Tensile Strength of some Binder Formulations using some Commercially available Materials in the Laboratory Muller.

| Formulation/kg Sand | | | Ottawa Silica Domtar Limestone | | Ottawa Silica Barnes 501 | | Champlain Sand Barnes 501 | |
|---|---|---|---|---|---|---|---|---|
| Limestone g | Volume 1:1.6 mL | Acid 2:1 mL | Tensile Strength psi | Relative Humidity % | Tensile Strength psi | Relative Humidity % | Tensile Strength psi | Relative Humidity % |
| 50 | | 50 | | | | | 191 | 32 |

*Maximum strength reached
[1]Mixture of 50 w/o grade (Steep Rock Calcite) and Domtar Limestone

Summary of Desirable Features of Mould Binder Components According to the Present Invention This family of binder components have the desirable features of being substantially odour free, non-toxic and non-polluting. Moulds made with them strip easily from the pattern, show satisfactory-to-excellent strength and hardness, are of good dimensional accuracy and replicate pattern detail faithfully. The loss of strength after exposure to elevated temperatures allows the unhindered shrinkage of the solidifying metal, facilitates the removal of the casting from the mould and encourages the reclamation of the sand from the spent mould.

Equally important, these binder components are compatible with existing foundry equipment, thus the selection of particular acids may be made on the basis of equipment at hand, metal to be cast, method of sand reclamation to be employed, etc. Since these acids react at different rates with, for example, crushed limestone, high speed mixers and moulding practices permit the use of rapidly hardening types, e.g. aqueous solution of 50 w/o citric acid, or an even more reactive tartaric acid solution. By comparison, commercial 88 w/o lactic acid solutions react more slowly with the same oxide precursor. Mixtures of acids, different water contents and the incorporation of humectant also have desirable effects, all of which may be exploited to advantage.

Similarly, mixtures may be modified to suit prevailing or anticipated atmospheric conditions (e.g. citric acid/-limestone bonded moulds have been found to be affected to a greater extent by low relative humidity conditions than lactic acid/limestone bonded ones. Under humid conditions the situation was found to reverse).

Selection of acid may also be influenced by the preferred cationic precipitant or vice versa, e.g. gluconic acid reacts slowly with crushed limestone.

In a situation where the formation of a "peel" is deemed advantageous, as in, for instance, steel casting, the use of citric acid as a binder component promotes the development of a "peel" layer, underneath which the casting is smooth and tends to be blemish free.

Examples of Preferred Binder Syrup Formulations

| | | | |
|---|---|---|---|
| (a) | | Citric Acid 50–60 w/o solution | 8 parts by volume |
| | | Lactic Acid 88 w/o solution | 5 parts by volume |
| | i.e. | approx. 33 w/o each of water, citric and lactic acids | |
| | | Addition of 5 w/o sorbitol when required. | |
| (b) | | Gluconic acid - 50 w/o solution | 1 wt. |
| | | Citric acid - hydrous | 1 wt. |
| | i.e. | Citric acid 45.6 w/o approx | |
| | | Gluconic acid | 25 w/o |
| | | Water | 29.3 w/o approx |

This syrup was stable up to 5 days @ 20° C.

| | | | |
|---|---|---|---|
| (c) | | Gluconic acid - 50 w/o solution | 1 wt. |
| | | Citric acid - anhydrous | 1 wt. |
| | i.e. | Citric acid | 50 w/o |
| | | Gluconic acid | 25 w/o |
| | | Water | 25 w/o |

This solution rejected solids upon cooling to 20° C. and holding at that temperature.

| | | | |
|---|---|---|---|
| (d) | | Gluconic acid - 50 w/o solution | 9 wts. |
| | | Citric acid - anyhydrous | 9 wts. |
| | | Sorbitol | 2 wts. |
| | i.e. | Citric acid | 45 w/o |
| | | Gluconic acid | 22.5 w/o |
| | | Sorbitol | 10 w/o |
| | | Water | 22.5 w/o |

This syrup was stable, and did not reject solids upon cooling to room temperature.

| | | | |
|---|---|---|---|
| (e) | | Citric acid - 50 w/o solution | 2 wts. |
| | | Citric acid - anhydrous | 2 wts. |
| | | Sorbitol | 1 wt. |
| | i.e. | Citric acid | 60 w/o |
| | | Sorbitol | 20 w/o |
| | | Water | 20 w/o |

This syrup was sluggish at room temperature and required re-heating to restore fluidity to help metering. This syrup did not reject solids when cooled to 12°–14° C.

| | | | |
|---|---|---|---|
| (f) | | Gluconic acid - 50 w/o solution | 3 wts |
| | | Malic acid powder | 2 wts |
| | i.e. | Gluconic acid | 30 w/o |
| | | Malic acid | 40 w/o |
| | | Water | 30 w/o |

In other embodiments of the present invention, at least a portion of the precipitant is provided by being present in the foundry sand as the foundry sand is found in nature.

We claim:

1. A method of manufacturing a foundry mould mix containing a mould binder, comprising:

(a) mixing a binder with foundry sand in the range 15 to 150 grams of binder per kilogram of foundry sand, the binder consisting essentially of:

(i) at least one acid selected from the group consisting of glycolic acid, lactic acid, α-hydroxy butyric acid, valerolactic acid, α-hydroxy-caproic aicd, tartronic acid, tartaric acid, malic acid, mucic acid, citric acid, gluconic acid, and glyceric acid;

(ii) a precipitant for the acid, the amount of precipitant present in the binder components being equivalent to at least 50% of the stoichiometric requirement of the total acid content of the binder components, said precipitant comprising at least one substance selected from the group consisting of calcium carbonate and substances composed essentially of calcium carbonate, said precipitant being substantially non-fluxing with the foundry sand, and substantially non-reactive with respect to other mould components than the said total acid content, and substantially non-reactive with respect to metal which is to be cast in the mould; and (b) water, the water being present in an amount no greater than 2 times the weight of the total acid content, calculated on that acid content being in a water free state.

2. A method according to claim 1 wherein the precipitant is ground limestone.

3. A method according to claim 2 wherein the amount of precipitant is in an amount equivalent to at least 200% of the stoichiometric requirement of the total acid content of the binder components.

4. A method according to claim 1 which further includes mixing at least one humectant with the other binder components.

5. A method according to claim 4 wherein the humectant mixed with the other components is sorbitol.

* * * * *